US007990351B2

(12) United States Patent
Lew et al.

(10) Patent No.: US 7,990,351 B2
(45) Date of Patent: Aug. 2, 2011

(54) DRIVING CIRCUIT FOR LIQUID CRYSTAL DISPLAY DEVICE

(75) Inventors: Ji-Ho Lew, Chungcheongbuk-do (KR); Yoo-Chang Sung, Chungcheongbuk-do (KR); Sun-Man So, Chungcheongbuk-do (KR)

(73) Assignee: MagnaChip Semiconductor Ltd., Chungcheongbuk-do (KR)

( * ) Notice: Subject to any disclaimer, the term of this patent is extended or adjusted under 35 U.S.C. 154(b) by 923 days.

(21) Appl. No.: 11/410,097

(22) Filed: Apr. 25, 2006

(65) Prior Publication Data

US 2006/0238477 A1 Oct. 26, 2006

(30) Foreign Application Priority Data

Apr. 26, 2005 (KR) ..... 10-2005-0034619

(51) Int. Cl.
*G09G 3/36* (2006.01)

(52) U.S. Cl. ..... 345/87; 345/98

(58) Field of Classification Search ..... 345/87, 345/98

See application file for complete search history.

(56) References Cited

U.S. PATENT DOCUMENTS 6,724,251 B1 * 4/2004 Ziazadeh et al. ..... 330/86

FOREIGN PATENT DOCUMENTS

| | | |
|---|---|---|
| JP | 03-167977 | 7/1991 |
| JP | 05-297830 | 11/1993 |
| JP | 2005-070627 | 3/2005 |
| KR | 2004-0048446 | 6/2004 |

* cited by examiner

*Primary Examiner* — Amare Mengistu
*Assistant Examiner* — Insa Sadio
(74) *Attorney, Agent, or Firm* — Morgan, Lewis & Bockius LLP

(57) ABSTRACT

A driving circuit for Liquid Crystal Display (LCD) device includes a unity-gain operation amplifier (OP amp), three switches, and two capacitors. The unity-gain OP amp buffers and carries a signal voltage on a transmission line. The first switch switches a connection between a noninverting terminal of the unity-gain OP amp and an input line of the signal voltage. One end of the second switch is connected to the input line of the signal voltage. One end of the third switch is connected to the noninverting terminal of the unity-gain OP amp. The first capacitor is connected between the other end of the third switch and the other end of the second switch. The second capacitor is connected between the other end of the first capacitor and the ground voltage terminal.

4 Claims, 7 Drawing Sheets

DRIVING CIRCUIT FOR LIQUID CRYSTAL DISPLAY DEVICE

FIELD OF THE INVENTION

The present invention relates to a driving circuit for Liquid Crystal Display (LCD) device; and, more particularly, to a driving circuit and method adapted to apply to a large-area and high-resolution LCD device.

DESCRIPTION OF RELATED ART

An LCD device, one of flat display devices for displaying characters, symbols, or graphics is a display device that combines liquid crystal technology with semiconductor technology using an optical property of liquid crystal that allows molecule array to be varied by an electric field. A Thin Film Transistor-LCD (TFT-LCD) device employs TFT as a switching device that turns on/off its inner pixels, which are turned on/off by turning on/off such TFT. A conventional TFT-LCD device, as shown in FIG. 1, is implemented in such a manner that cells constituting pixels are arranged in an array form, each cell including a liquid crystal cell $C_{LC}$, a storage capacitor $C_{ST}$, and a TFT serving as a switch.

A source electrode of each TFT is commonly connected in columns to form data lines (D1 to Dn) and then connected to a data driver 10; and a gate electrode of each TFT is commonly coupled in rows to build up scan lines (S1 to Sm) and then connected to a gate driver 20. By doing so, a display device with N×M resolution is implemented. In this structure, the data driver 10 is called source driver or column driver; and generally has a structure as shown in FIG. 2.

When an area of LCD is large and its resolution is high, an RC delay increases due to an extended data line of LCD. Further, as the resolution becomes high, a given scan period, i.e., a time to turn on TFT of pixel decreases. The RC delay of data line and the decrease of scan period cause a distortion of signal voltage, which presents at a terminal stage of transmission line, as shown in FIG. 3. This prevents a data signal that must be charged in pixel within a given scan period of TFT from being charged or discharged the signal therefrom, thus making a desired data signal not correctly displayed in pixel.

FIG. 4 is a schematic circuit diagram depicting a conventional driving circuit for Liquid Crystal Display (LCD).

The conventional driving circuit provides an output image signal voltage by adding a pre-emphasis voltage, shortens a delay time taken until reaching a target voltage owing to RC delay by adding the pre-emphasis voltage to a data waveform to be delivered to a source driver, compared to the existing devices. However, a structure of the prior art device, as shown in FIG. 4, requires a large layout area and a complicated control process because of six switches therein and support circuits for issuance of signals to control those switches.

SUMMARY OF THE INVENTION

It is, therefore, a primary object of the present invention to provide a driving circuit for LCD device using a pre-emphasis voltage addition scheme that needs less layout area.

Another object of the present invention is to offer a driving circuit for LCD device using a pre-emphasis voltage addition scheme of a more simple control structure.

Still another object of the invention is to provide a driving circuit for LCD device using a pre-emphasis voltage addition scheme, which is capable of compensating an output signal of an output buffer by an RC delay and a decrease of scan period within a more rapid time.

In accordance with the present invention, there is provided a driving circuit for Liquid Crystal Display (LCD) device, comprising: a unity-gain operational amplifier (OP amp) for buffering and carrying a signal voltage on a transmission line; a first switch for switching a connection between a noninverting terminal of the unity-gain OP amp and an input line of the signal voltage; a second switch whose one end is connected to the input line of the signal voltage; a third switch whose one end is connected to the noninverting terminal of the unity-gain OP amp; a first capacitor whose one end is connected to the other end of the third switch and other end is connected to the other end of the second switch; and a second capacitor whose one end is connected to the other end of the first capacitor and other end is connected to the ground voltage terminal.

The other objectives and advantages of the invention will be understood by the following description and will also be appreciated by the embodiments of the invention more clearly. Further, the objectives and advantages of the invention will readily be seen that they can be realized by the means and its combination specified in the claims.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE INVENTION

Figure 1:
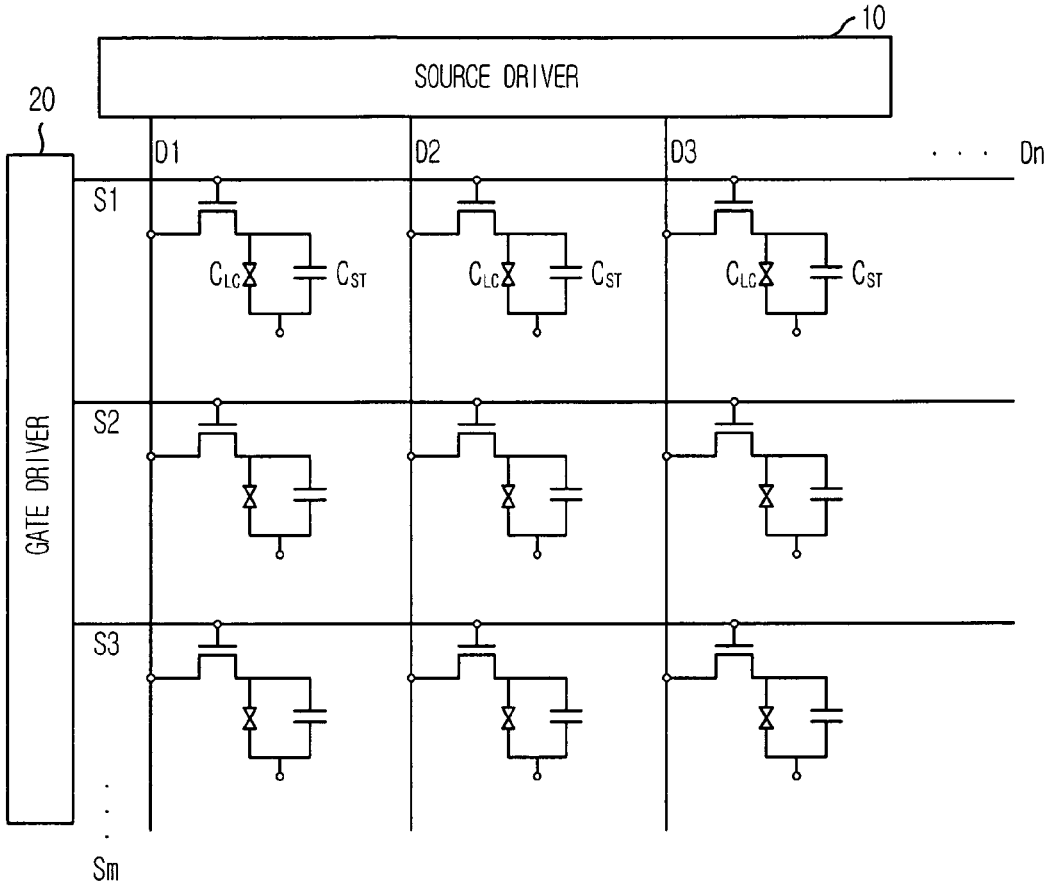
FIG. 1 (RELATED ART)
FIG. 1 is a circuitry diagram showing a structure of a conventional TFT-LCD panel.

Hereinafter, a preferred embodiment of the present invention will be set forth in detail with reference to the accompanying drawings. First, it should be noted that the terms and words used in this specification and claims should not be limited to general or dictionary meanings but be interpreted as meanings and concepts which coincide with the technical spirit of the invention under the principle that the inventor(s) may properly define the concept of the terms to explain his/her own invention in the best manner. Accordingly, the embodiments disclosed herein and constructions shown in the drawings are merely the most preferred ones of the present invention, not teaching all of the technical spirit of the present invention. Therefore, those in the art will appreciate that various modifications, substitutions and equivalences may be made, without departing from the scope of the invention as defined in the accompanying claims.

Figure 5:
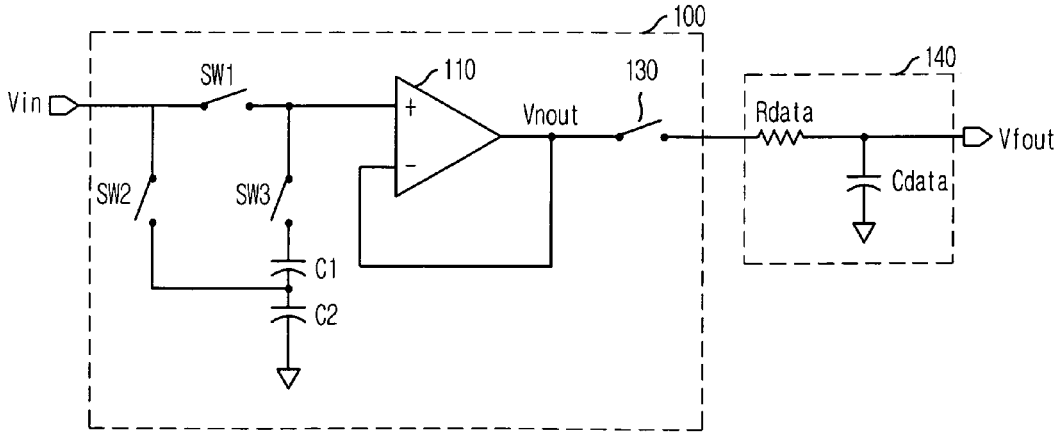
FIG. 5 is a circuitry diagram of a driving circuit for LCD device in accordance with an embodiment of the present invention.

FIG. 5 illustrates a circuitry diagram of an LCD driving circuit in accordance with a first embodiment of the present invention. By employing the LCD driving circuit as shown therein, an image signal voltage amplified under the state that a pre-emphasis voltage is added can be outputted.

The LCD driving circuit 100 comprises a unity-gain operational amplifier (OP amp) 110 for buffering a signal voltage and carrying it on a transmission line, a first switch SW1 for switching a connection between an input terminal (noninverting terminal) of the unity-gain OP amp 110 and an input line Vin of the signal voltage, a second switch SW2 whose one end is connected to the signal voltage input line Vin, a third switch SW3 whose one end is connected to the input terminal of the unity-gain OP amp 110, a first capacitor C1 whose one end is connected to the other end of the third switch SW3 and other end is connected to the other end of the second switch SW2, and a second capacitor C2 whose one end is connected to the other end of the first capacitor C1 and other end is connected to the ground voltage terminal.

Figure 2:
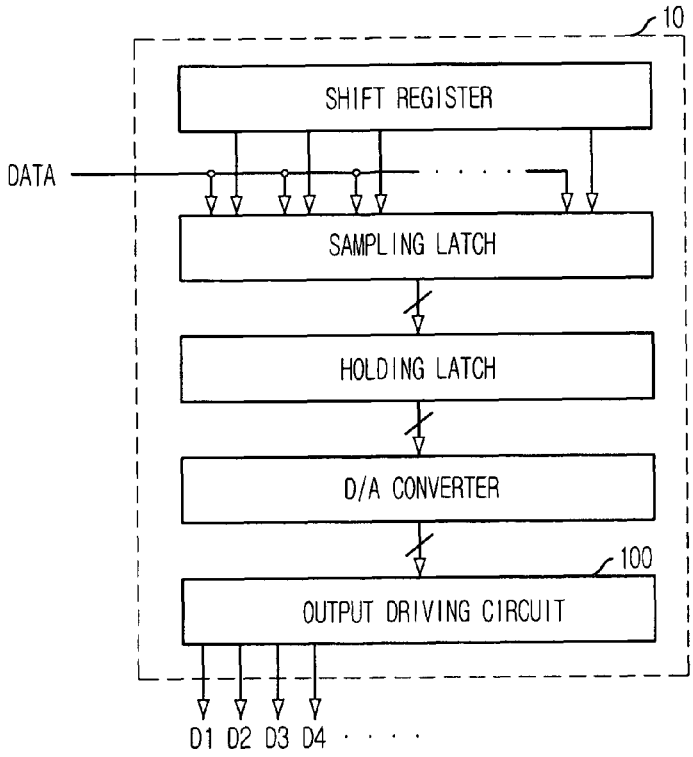
FIG. 2 (RELATED ART)
FIG. 2 is a block diagram showing a structure of a data driver of a general LCD device.
Figure 3:
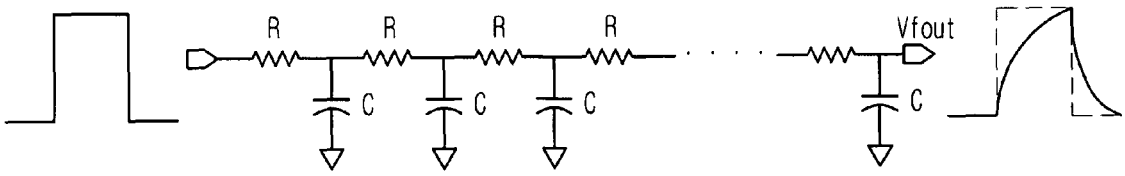
FIG. 3 (RELATED ART)
FIG. 3 is a diagram showing a delay result of signal due to RC effect of transmission line.
Figure 4:
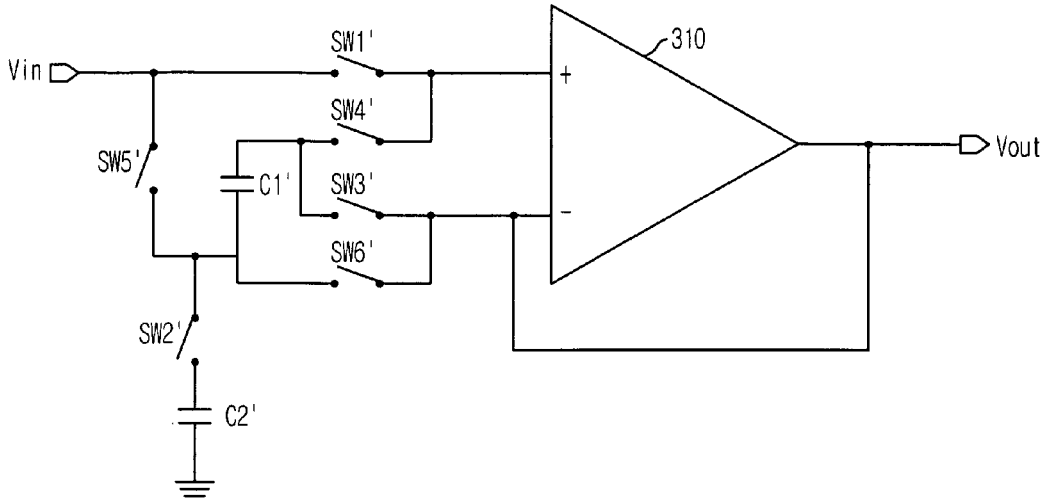
FIG. 4 (RELATED ART)
FIG. 4 is a circuitry diagram showing a conventional driving circuit for LCD device as incorporated herein by reference.

This embodiment implements a driving buffer with the unity-gain OP amp 110 whose inverting terminal and output terminal are connected. The input image signal voltage terminal Vin of the driving circuit coupled with a D/A converter (FIG. 2) is connected to the noninverting terminal of the OP amp 110 via the first switch SW1. The two capacitors C1 and C2 are connected in series, wherein a terminal stage of the first capacitor C1 is coupled with the noninverting terminal of the OP amp 110 via the third switch SW3. A node between the two capacitors C1 and C2 is connected to the input signal voltage terminal Vin via the second switch SW2. An output image signal voltage terminal Vnout of the OP amp 110 is connected to a power-saving switch 130 for low power consumption for cutting-off the signal when the driving circuit is not operated. The power-saving switch 130 is connected to a resistor Rdata and a capacitor Cdata constituting an equivalent data line model 140 of FIG. 4, wherein a data line voltage Vfout representing the essential point of the invention is provided onto an output line of the line model 140. In any implementation where the power-saving function is not important, the power-saving switch 130 may be excluded. The first switch SW1 is operated in response to a first control signal CTRL1, the second switch SW2 is operated in response to a second control signal CTRL2, and the third switch SW3 is operated in response to a third control signal CTRL3. This embodiment may include a switch controller (not shown) for creating the three control signals.

Figure 6:
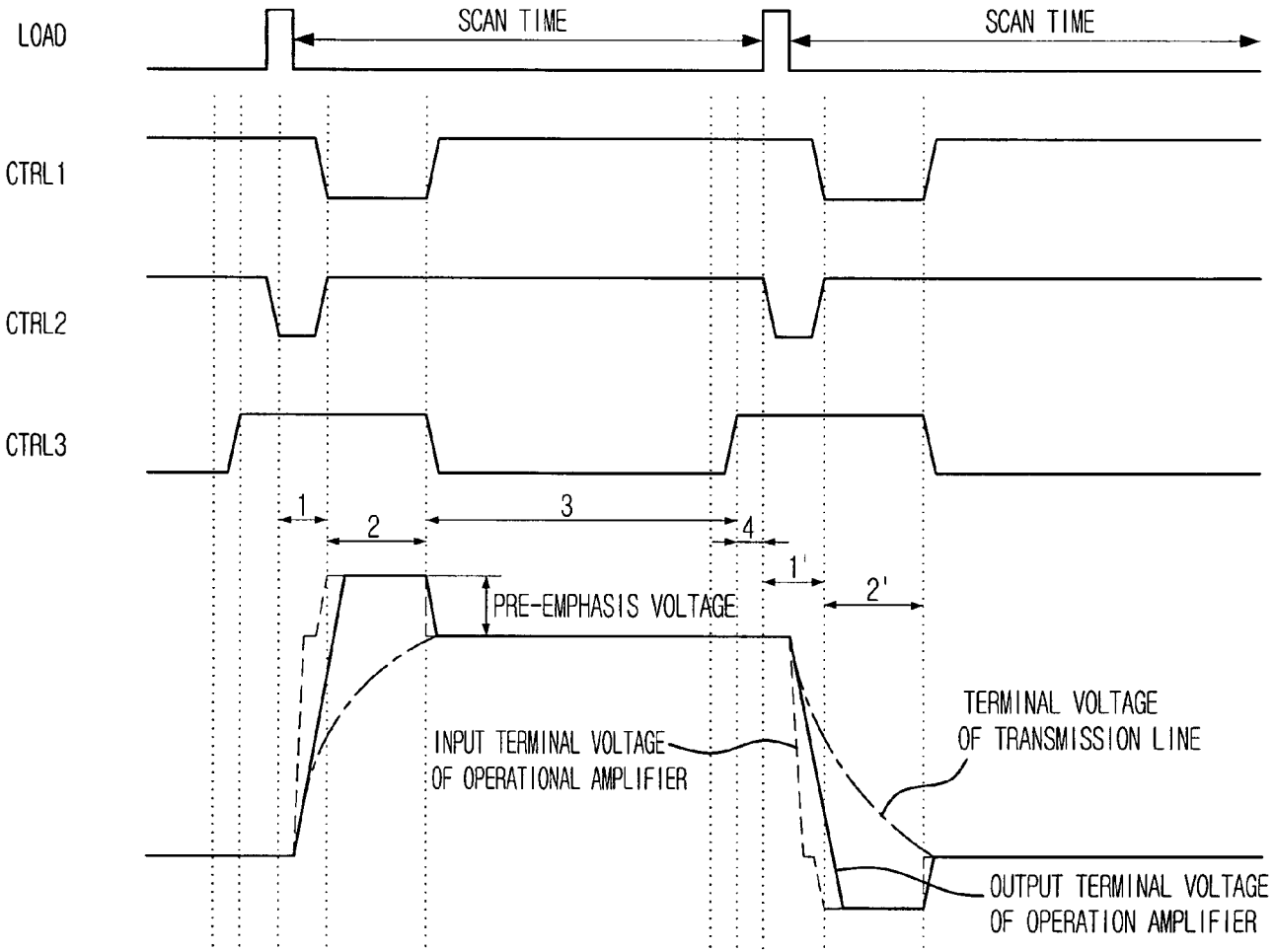
FIG. 6 is a timing chart illustrating a driving method for LCD device in accordance with an embodiment of the present invention.
Figure 10:
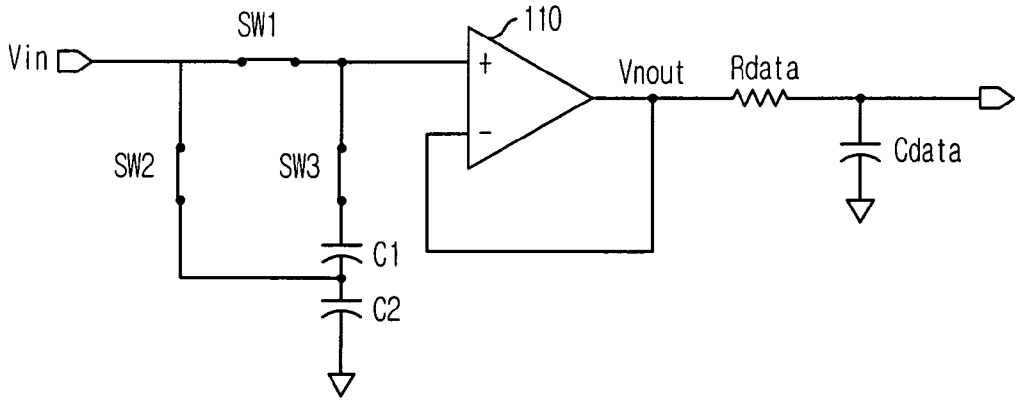
FIG. 10 is a circuitry diagram showing a switch state at a discharging step for the pre-emphasis-voltage of the driving circuit for LCD device in accordance with the embodiment of the present invention.

FIG. 6 is a timing chart illustrating the operation of the output driving circuit in accordance with the present invention. The timing chart shows an external load signal LOAD deciding a scan period, a noninverting terminal signal of the driving buffer, and an output image signal voltage and a data line voltage of the driving buffer. The degree of the pre-emphasis voltage is decided depending on a ratio of capacitance values of the capacitors C1 and C2 connected to the output buffer shown in FIG. 5. A time when the pre-emphasis voltage is added is decided based on the control signals of FIG. 6 (especially, the signals at an interval 2). Now, an operation of the driving circuit of this embodiment will be described below in detail with reference to FIGS. 6 and 7 in parallel with FIG. 10.

Figure 7:
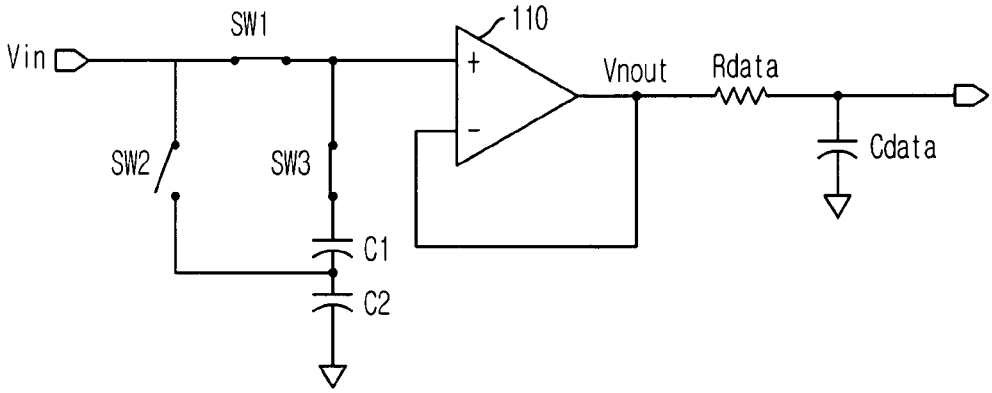
FIG. 7 is a circuitry diagram showing a switch state at a charging step for pre-emphasis-voltage of the driving circuit for LCD device in accordance with the embodiment of the present invention.

First, when the load signal LOAD denoting the start of a given scan period is activated, the first and the third switches SW1 and SW3 are turned on and the second switch SW2 is turned off at step S110, as depicted in FIG. 7. This process at step S110 is made by having the logic states of the three switch control signals CTRL1, CTRL2, CTRL3 maintained for an interval "1," as shown in FIG. 6. The input image signal voltage Vin in FIG. 7 is amplified by the unity-gain op amp 110; and then outputted and charged in the capacitors C1 and C2 coupled in series.

Figure 8:
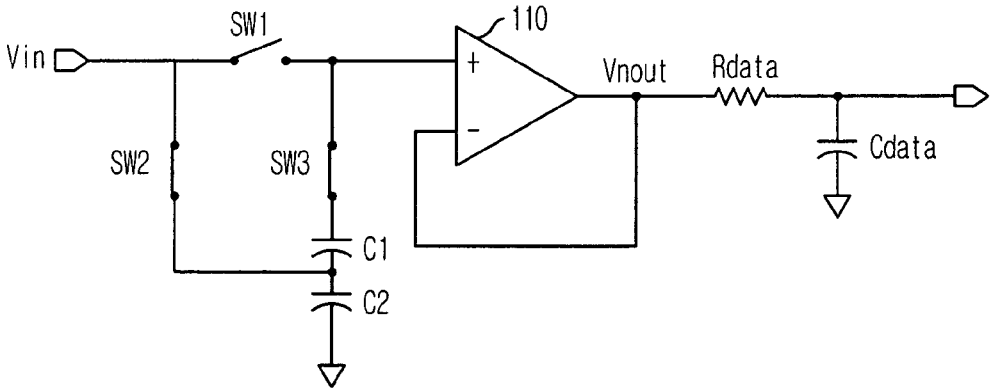
FIG. 8 is a circuitry diagram showing a switch state at an output step reflecting the pre-emphasis-voltage of the driving circuit for LCD device in accordance with the embodiment of the present invention.

After performing the process at step S110, when a time during which an electric charge sufficient to give the pre-emphasis voltage is charged in the capacitors C1 and C2 connected in series is passed, the first switch SW1 is turned off and the second and the third switches SW2 and SW3 are turned on at step S120, as shown in FIG. 8. The process at step S120 is made by maintaining the logic states of the three switch control signals CTRL1, CTRL2, CTRL3 for an interval "2," as shown in FIG. 6. Accordingly, a charge voltage of both ends of the first capacitor C1 on which the electric charge for pre-emphasis voltage is stored is added to the input image signal voltage Vin and then the input image signal voltage added to the pre-emphasis voltage is applied to the input terminal of the unity-gain OP amp 110 for its amplification and output. By doing so, the amplified input image signal voltage added to the pre-emphasis voltage can be carried on a transmission line as the output image signal voltage. It can be seen from FIG. 6 that the interval 2 of the process performed at step S120 is a time interval during which the pre-emphasis voltage carries.

Figure 9:
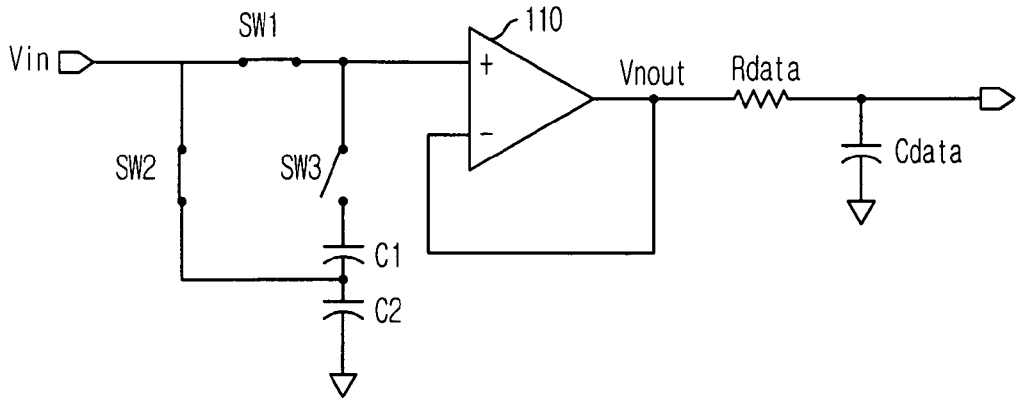
FIG. 9 is a circuitry diagram showing a switch state at an output step excluding the pre-emphasis-voltage of the driving circuit for LCD device in accordance with the embodiment of the present invention.

After the process at step S120, when a time during which the sufficient pre-emphasis voltage is carried on the output image signal is passed, the first and the second switches SW1 and SW2 are turned on and the third switch SW3 is turned off at step S130, as shown in FIG. 9. The process at step S130 is made by making the logic states of the three switch control signals CTRL1, CTRL2, CTRL3 maintained for an interval "3," as shown in FIG. 6. Accordingly, during the interval "3" of the process at step S130, the unity-gain OP amp 110 takes only the input image signal voltage Vin excluding the pre-emphasis voltage and outputs the same to the transmission line.

Roughly seeing, it may be judged that it is possible to obtain the waveform of the pre-emphasis voltage by conducting the following step S140 directly after the process of step S120 while bypassing the process at step S130. However, if the first capacitor C1 starts to discharge as soon as the addition interval (the interval "2" of FIG. 6) of the pre-emphasis voltage has expired, there occur problems such as creation of ripples and/or issuance of reverse-directional current to input terminal (D/A converter) due to the electric charge stored in the first capacitor C1. To prevent the above problems, the driving circuit of this embodiment is provided with the third switch SW3 and the process of step S130, wherein the discharge of the first capacitor C1 is made after passing said step S130. With this process, ripples are alleviated owing to leakage current during the discharge time; and do not affect image since that time would be after expiration of the given scan period although there exist any ripples.

After the process at step S130, when a time sufficient to display a desired image on a display panel is passed and before starting scan for a next scan line, the first to third switches SW1 to SW3 are turned on at step S140. The process of step S140 is conducted by having logic states of the three switch control signals CTRL1, CTRL2, CTRL3 maintained for an interval "4," as shown in FIG. 6. And the process at step S140 has a sufficient time needed for discharging of the first capacitor C1. Accordingly, the first capacitor C1 on which the pre-emphasis voltage is stored gets become a short state and is completely discharged; and only the input image signal voltage Vin excluding the pre-emphasis voltage is provided to the unity-gain OP amp 110 for its amplification and output.

Upon completion of step S140 above, the process of step S110 is again initiated for a next scan line. FIG. 6 is applied to a driver that performs line inversion to change a polarity of an applied voltage every scan line. Thus, the pre-emphasis voltage for a next scan line has an opposite polarity. By repeating this driving sequence every scan line, the pre-emphasis voltage can be added to the output image signal voltage of the data driver.

The driving method of this embodiment using the pre-emphasis voltage is more useful to a driver device that carries out line inversion. In other words, there may be a signal distortion due to signal delay on transmission line at a disable end of scan line driving signal; but the distortion may be mitigated owing to an abrupt slope of next scan line driving signal inverted at its enable end in case where the line inversion is conducted.

Figure 11:
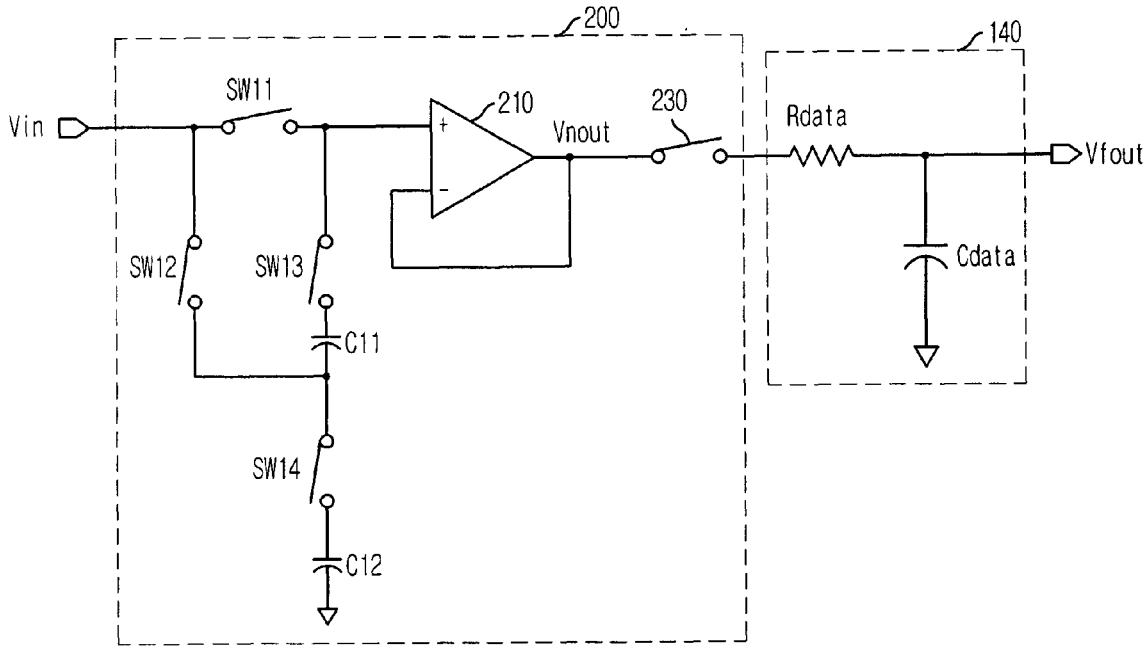
FIG. 11 is a circuitry diagram of a driving circuit for LCD device in accordance with another embodiment of the present invention.

An LCD driving circuit 200 of a second embodiment of the invention, as shown in FIG. 11, comprises a unity-gain OP amp 210 of single gain for buffering a signal voltage and carrying it on a transmission line, a first switch SW11 for switching a connection between an input terminal (noninverting terminal) of the unity-gain OP amp 210 and an input line Vin of the signal voltage, a second switch SW12 whose one end is connected to the signal voltage input line Vin, a third switch SW13 whose one end is connected to the input terminal of the unity-gain OP amp 210, a first capacitor C11 whose one end is connected to the other end of the third switch SW13 and other end is connected to the other end of the second switch SW12, a second capacitor C12 whose one end is connected to the other end of the first capacitor C11 and the other end is connected to the ground voltage terminal, and a fourth switch SW14 arranged between the first and the second capacitors C11 and C12 for switching a connection therebetween.

The construction of the LCD driving circuit 200 of this embodiment is the same as that of the first embodiment except that the fourth switch SW14 is disposed between the first and the second capacitors C11 and C12. Accordingly, there will be described in detail with respect to only the fourth switch SW14 in the following description, wherein the other constructional elements corresponding to the first embodiment excluding the fourth switch will be omitted.

In the LCD driving circuit as structured above, the fourth switch SW14 is initially turned on and then turned off during the second and the third switches SW12 and SW13 are turned on and the first switch SW11 is turned off (in case of the first embodiment, the process of step S120 of FIG. 8). During the fourth switch SW14 is turned off, the charge voltage of both ends of the first capacitor C11 where the electric charge is stored for the pre-emphasis voltage is added to the input image signal voltage Vin. Then, the input image signal voltage added to the pre-emphasis voltage is connected to the input terminal of the unity-gain OP amp 210 for its amplification and output, thereby carrying it on the transmission line.

In the first embodiment, there has existed a possibility that the noninverting terminal voltage of the unity-gain OP amp 210 is affected by charging the input voltage carried on the signal voltage input line Vin in the second capacitor C2 or discharging it therefrom, or by the ground voltage terminal coupled via the second capacitor C2, at step S120 of FIG. 8. However, the second embodiment of the invention prevents the above problem by turning off the fourth switch SW14 during that period.

As a result, the present invention has an advantage in that it has a more simple structure while performing the same function as the prior art by employing the LCD driving circuit of the invention, thereby saving a layout area and/or a manufacturing cost.

The present application contains subject matter related to Korean patent application No. 2005-34619, filed with the Korean Intellectual Property Office on Apr. 26, 2005, the entire contents of which are incorporated herein by reference.

While the present invention has been described with respect to the particular embodiments, it will be apparent to those skilled in the art that various changes and modifications may be made without departing from the spirit and scope of the invention as defined in the following claims.

What is claimed is:

1. A driving circuit for Liquid Crystal Display (LCD) device, comprising:

a unity-gain operational amplifier (OP amp) for buffering and carrying a signal voltage on a transmission line;

a first switch for switching a connection between a noninverting terminal of the unity-gain OP amp and an input line of the signal voltage;

a second switch whose one end is connected to the input line of the signal voltage;

a third switch whose one end is connected to the noninverting terminal of the unity-gain OP amp;

a first capacitor whose one end is connected to the other end of the third switch and other end is connected to the other end of the second switch, wherein the one end of the first capacitor is coupled through the noninverting terminal of the unit-gain OP amp through the third switch and does not have any connection with an inverting terminal of the unit-gain OP amp, and wherein the driving circuit use the first, second and third switches for controlling its operation and the first capacitor is charged and discharged only by the input line;

a second capacitor whose one end is connected to the other end of the first capacitor and other end is connected to the ground voltage terminal, and a switch controller for generating a plurality of control signals to control the first to third switches, wherein the switch controller generates:

the control signals to turn on the first and the third switches and turn off the second switch to first duration for storing a portion of an output image signal voltage in the first capacitor as a pre-emphasis voltage;

the control signals turn on the first and the second switches and turn off the third switch for a third duration for amplifying and outputting only the input image signal voltage excluding the pre-emphasis voltage; and the control signals to turn on the first on third switches for a fourth duration for removing an electronic charged in the first capacitor.

2. The driving circuit for LCD device as recited in claim 1, further comprising a power-saving switch for turning off a connection between the unity-gain OP amp and the transmission line when the unity-gain OP amplifier is not operated.

3. The driving circuit for LCD device as recited in any one of claims 1 to 2, further comprising a fourth switch for switching a connection between the first and the second capacitors, wherein the fourth switch is initially turned on and turned off during the second duration.

4. The driving method for LCD device as recited in claim 1, wherein the switch controller generates:

the control signal to turn on the first and the third switches and turn off the second switch from a time when a signal denoting a start of scan period is activated to a time sufficient to charge the electric charge for the pre-emphasis voltage in the first capacitor, and the control signals to turn on the first to third switches form before expiration of a scan period during which a time sufficient to display a desired image on the display panel is passed to prior to starting the first duration for a next scan line.

* * * * *